United States Patent [19]

Henneberger et al.

[11] Patent Number: 4,920,668

[45] Date of Patent: May 1, 1990

[54] STEAM IRON WITH PRESSURE EQUALIZATION CONDUIT

[75] Inventors: Gerd Henneberger, Neu Isenburg; Gerald Reiss, Heusenstamm, both of Fed. Rep. of Germany

[73] Assignee: Rowenta-Werke GmbH, Offenbach am Main, Fed. Rep. of Germany

[21] Appl. No.: 189,649

[22] Filed: May 3, 1988

[30] Foreign Application Priority Data

May 6, 1987 [DE] Fed. Rep. of Germany ..... 3715059

[51] Int. Cl.[5] ..... D06F 75/18

[52] U.S. Cl. ..... 38/77.81; 38/77.8

[58] Field of Search ..... 38/77.83, 77.6, 77.81, 38/77.7, 77.9, 77.8, 77.82; 99/307

[56] References Cited

U.S. PATENT DOCUMENTS

| | | | |
|---|---|---|---|
| 2,387,281 | 10/1945 | Morton . | |
| 2,892,272 | 6/1959 | Finlayson et al. . | |
| 3,371,592 | 3/1968 | Remy et al. | 99/307 |
| 4,196,340 | 4/1980 | Evans, Jr. et al. | 38/77.9 X |
| 4,535,556 | 8/1985 | Cavalli | 38/77.6 |
| 4,550,514 | 11/1985 | Reiss et al. | 38/77.81 |
| 4,571,862 | 2/1986 | Costa | 38/77.81 |
| 4,586,277 | 5/1986 | Reiss et al. | 38/77.83 X |

FOREIGN PATENT DOCUMENTS

| | | | |
|---|---|---|---|
| 3328453 | 1/1985 | Fed. Rep. of Germany . | |
| 1141318 | 1/1969 | United Kingdom | 38/77.8 |
| 2065176 | 6/1981 | United Kingdom | 38/77.82 |

*Primary Examiner*—Andrew M. Falik

*Attorney, Agent, or Firm*—Toren, McGeady & Associates

[57] ABSTRACT

A steam iron has a closed water tank 4 and a drip valve 9 for supplying water from the water tank to a vaporization chamber 14. Connected to the water tank is a pressure generator 1, the pressure end of which acts on the interior of the tank. The tank interior is connected to the sole of the iron via a pressure tube 12.

6 Claims, 1 Drawing Sheet

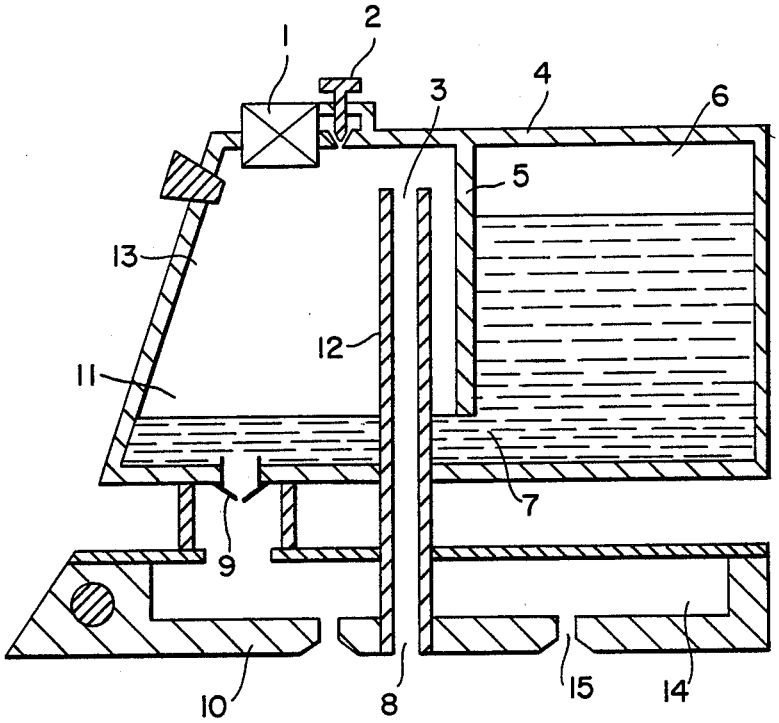
1
2
3
4
6
5
13
12
11
7
9
10
8
15
14

STEAM IRON WITH PRESSURE EQUALIZATION CONDUIT

BACKGROUND OF THE INVENTION

The invention relates to a steam iron having a water tank, a vaporization chamber and a drip valve for supplying water from the water tank to the vaporization chamber.

For steam ironing, in the case of steam irons operating on the drip principle, a specific quantity of water is supplied from the water tank to the steam or vaporization chamber provided in the sole of the iron via a drip valve. Because of the nature of the material being ironed and the contact pressure, the steam generated in the steam chamber during the steam ironing operation cannot escape unobstructed from the steam channels opening out on the sole of the iron into the atmosphere and consequently pressure builds up in the steam chamber. This pressure affects the quantity of water flowing out of the drip valve into the steam chamber and consequently the quantity of steam escaping from the steam holes in the sole of the steam iron. The pressure in the steam chamber is dependent on the permeability of the material being ironed and the pressure with which the iron is pressed on to the material. The higher the pressure in the steam chamber, the less water flows out of the drip valve into the steam chamber and the less steam is released from the steam escape holes.

In order to equalize the pressure difference within the steam chamber and the inside of the tank, it has already been proposed that the tank and steam chamber be connected to each other by means of a pressure equalization tube (U.S. Pat. No. 2,892,272). This device is supposed to ensure that the same quantity of steam always leaves the steam escape holes, dependent only on the water level in the tank. However, equalization of the quantity of steam released from the sole is not the only feature necessary to ensure good ironing results. It is of particular importance that, depending on the density and type of fabric being ironed and the sole pressure on the material, different quantities of steam are required, while without any bearing pressure the minimum possible quantity of steam should be generated. Adaptation of the quantity of steam to the counterpressure acting on the sole or the steam escape holes provided therein is not possible with the known pressure equalization means. Furthermore, the steam may condense in the pressure equalization tube, with the condensation being deposited in the pressure equalization tube, which in turn may cause blockage of the tube. Such blockages will render the desired pressure equalization ineffective.

SUMMARY OF THE INVENTION

One aim of this invention is therefore to provide a steam iron which, while substantially avoiding the disadvantages mentioned above, can release the quantity of steam necessary for any particular ironing operation, despite the tendency of the steam escape path in the sole of the iron to be blocked during ironing by external influences such as, for example, contact pressure, density of fabric, thickness of fabric, the nature of the ironing surface, etc.

According to the invention there is provided a steam iron having a water tank, a vaporization chamber, a drip valve for supplying water from the water tank to the vaporization chamber, a pressure generator arranged to pressurize the interior of the water tank, and a conduit having one opening in the tank interior arranged to be above the water level during ironing, and another opening formed in the sole of the iron, whereby the tank interior is connected to the sole of the iron by the conduit.

At least in a preferred embodiment of the invention, the pressure generator is arranged to convey atmospheric air at a constant rate into the interior of the water tank. When the sole of the iron is not engaged with material to be ironed the conduit, which may be in the form of a pressure tube, connects the interior of the tank to atmosphere via its opening provided on the sole of the iron, so that no pressure will build up inside the tank in such a freely steaming iron. The quantity of water flowing into the vaporization chamber from the interior of the tank via the drip valve and, as a result, the quantity of steam produced in said chamber is constant.

During steam ironing, the quantity of steam produced in the vaporization chamber is unable to escape, because of the material being ironed, the ironing support and the contact pressure of the iron. Consequently, the pressure in the vaporization system consisting of the vaporization chamber and steam channels increases. This tends to reduce the quantity of water flowing into the vaporization chamber and accordingly to decrease the quantity of steam escaping from the steam outlet holes. However, at the same time the air flowing out of the water tank through the conduit or pressure tube is also decreased. Since the pressure generator conveys atmospheric air into the interior of the tank at a constant rate but this air is unable to escape through the pressure tube unimpeded, the pressure in the tank rises and as a result the quantity of water flowing into the vaporization chamber is increased and thus more steam is generated. In a preferred embodiment, the tendency for there to be a decrease in the quantity of steam caused by blockage of the steam outlet holes is not only fully compensated but advantageously there is an increase in the quantity of steam, beyond mere compensation.

According to a preferred embodiment of the invention, the interior of the tank contains a partition wall which divides the tank into two chambers. Preferably the chambers are connected to each other via a throughflow opening. For example the partition wall may be not joined to the wall of the tank at the bottom of the tank, which means that water is able to flow from one chamber into the other through the gap remaining at the bottom. Preferably the conduit, the drip valve and the pressure generator are arranged in the same chamber.

With such arrangements the majority of the water may be stored in the other chamber of the tank, so that the hydrostatic pressure acting on the drip valve is very low. By a suitable choice of annular cross section for the drip valve, the outflow opening can be kept so small that the capillary forces acting in the drip valve counteract the very low hydrostatic pressure in the water tank. As a consequence, when the steam escapes freely into the atmosphere, no water flows through the drip valve into the vaporization chamber. This state of equilibrium is not altered by the pressure generator either, since the air conveyed by the pressure generator is able to escape unimpeded through the conduit or pressure tube and no pressure builds up in the interior of the tank. Only when there is a reduction in the quantity of air leaving the pressure tube through the opening in the sole does the pressure inside the tank increase, thereby overcoming the capillary forces in the valve. The hydrostatic pressure and the pressure additionally generated by the pressure generator are then so great that water flows through the drip valve into the vaporization chamber.

Totally surprisingly, this arrangement results in a considerable energy saving since at times of rest no water flows into the vaporization chamber. The vaporization heat required to convert the water from the liquid phase to the gaseous phase is not taken from the vaporization chamber, which would otherwise be supplied immediately by the heating element provided.

Preferably the interior of the water tank is connected to atmosphere via a pressure selector. With such an arrangement the quantity of air conveyed by the pressure generator can be varied by means of the pressure selector. This in turn can bring about an increase or decrease in the steam production of the steam iron as desired. Such control of steam production may also be effected by an arrangement in which the output of the pressure generator is variable. Advantageously the iron includes electronic controls for the performance of the steam generator.

BRIEF DESCRIPTION OF THE DRAWING

A preferred embodiment of the invention will now be described by way of example and with reference to the accompanying drawing, which shows a schematic sectional view of a steam iron in accordance with the invention.

DETAILED DESCRIPTION OF THE PREFERRED EMBODIMENT

The steam iron shown consists of the sole 10 and the closable water tank 4. Inside the water tank 4 is a partition wall 5 which divides the tank interior 13 into two chambers 6 and 11. The chambers 6 and 11 are interconnected by a throughflow opening 7. A conduit or pressure tube 12 connects the chamber 11 to atmosphere, the opening 3 of the pressure tube 12 being located above the surface of the water while the opening 8 at the other end is formed in the sole 10 of the iron. The water required for vaporization flows out of the water tank 4 into the vaporization chamber 14 through the drip valve 9. A pressure generator 1 for example an air pump or ventilator and a pressure selector 2 are arranged on the water tank 4. The pressure generator 1 conveys atmospheric air into the interior of the chamber 11 and the pressure selector 2 connects the chamber 11 to the atmosphere.

When steam ironing is in progress, the pressure generator 1 conveys a defined amount of atmospheric air into the chamber 11 of the water tank 4. Since the steam generated in the vaporization chamber 14 is unable to escape because of the material being ironed, the ironing support and the contact pressure of the iron on the material, the pressure rises in the vaporization system consisting of the vaporization chamber 14 and pressure channels 15. As a result, the quantity of water flowing through the drip valve 9 into the vaporization chamber 14 decreases. At the same time, the air conveyed by the pressure generator 1 into the chamber 11 of the water tank 4 is no longer able to escape into the atmosphere via the pressure tube 12, with the result that the pressure in the chamber 11 increases as well. Consequently, still more water flows into the vaporization chamber 14, thereby not only compensating for the fall in the amount of steam but further increasing the quantity of steam produced.

In the resting position, no water flows through the drip valve 9 into the vaporization chamber 14. Because of the partition wall 5 which divides the water tank 4 into the two interconnected chambers 6 and 11, the hydrostatic pressure acting on the drip valve 9 is so low that, if the cross section of opening of the drip valve 9 is suitably chosen, the capillary forces acting therein will counteract the hydrostatic pressure in the chamber 11. As a result, when the vaporization system and the pressure tube 12 are freely connected to atmosphere, no water will flow out of the tank 4 into the vaporization chamber 14, even when the pressure generator 1 is switched on. The quantity of air conveyed by the pressure generator 1 can be varied by means of the pressure selector 2.

Modifications of the invention both in its broad aspects and its preferred embodiments may be apparent to persons skilled in the art and it is intended that such modifications be included within the scope of this disclosure.

We claim:

1. A steam iron having a water tank, a vaporization chamber, a drip valve for supplying water from the water tank to the vaporization chamber, the drip valve being the only opening between the tank and the vaporization chamber, pressure generator means for pressurizing the interior of the water tank, and a conduit having one opening in the tank interior arranged to be above the water level during ironing, and another opening formed in the sole of the iron, whereby the tank interior is connected to the sole of the iron by the conduit.

2. A steam iron as claimed in claim 1, wherein the water tank is divided into two chambers by a partition wall, the chambers being connected to each other via a throughflow opening, and wherein the conduit, the drip valve and the pressure generator means are arranged in the same chamber.

3. A steam iron as claimed in claim 1 or 2, wherein the interior of the water tank is connected to atmosphere via a pressure selector.

4. A steam iron as claimed in claim 1 or 2, wherein the pressure generator means has a variable output.

5. A steam iron as claimed in claim 1, wherein the pressure generator means includes an air pump.

6. A steam iron as claimed in claim 1, wherein the pressure generator means includes a ventilator.

* * * * *